US006289862B1

(12) United States Patent
Schäfer et al.

(10) Patent No.: US 6,289,862 B1
(45) Date of Patent: Sep. 18, 2001

(54) LOCKING UNIT FOR A DEVICE FOR MODIFYING THE TIMING OF CHARGE CHANGE VALVES IN INTERNAL COMBUSTION ENGINES

(75) Inventors: Jens Schäfer; Martin Steigerwald, both of Herzogenaurach; Matthias Kapp, Hemhofen, all of (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/623,148

(22) PCT Filed: Nov. 20, 1998

(86) PCT No.: PCT/EP98/07465

§ 371 Date: Aug. 28, 2000

§ 102(e) Date: Aug. 28, 2000

(87) PCT Pub. No.: WO99/43928

PCT Pub. Date: Sep. 2, 1999

(30) Foreign Application Priority Data

Feb. 28, 1998 (DE) ..... 198 08 619

(51) Int. Cl.[7] ..... F01L 1/344

(52) U.S. Cl. ..... 123/90.17; 74/568 R; 464/2

(58) Field of Search ..... 123/90.15, 90.17, 123/90.31; 74/568 R; 464/1, 2, 160

(56) References Cited

U.S. PATENT DOCUMENTS 4,858,572 8/1989 Shirai et al. ..... 123/90.12

6,170,447 * 1/2001 Kohrs et al. ..... 123/90.17

FOREIGN PATENT DOCUMENTS 19623818 12/1996 (DE) .

* cited by examiner

*Primary Examiner*—Weilun Lo
(74) *Attorney, Agent, or Firm*—Volpe & Koenig, PC

(57) ABSTRACT

A locking mechanism for a device (1) to modify the control timing of cylinder valves of an internal combustion engine, in particular for a vane-cell positioning device. The device (1) consists of a drive wheel (2) driven by a crankshaft of the internal combustion engine, said drive wheel having a cavity (6), and an impeller (8) permanently connected to the camshaft (7) that has at least one vane (12). In the cavity (6) of the drive wheel (2), at least one working chamber (15) is formed by intermediate walls (14) and each of these chambers is divided by an associated vane (12) into two hydraulic pressure spaces (16, 17). When pressure is applied by means of a hydraulic pressure medium, the pressure spaces (16, 17) effect a pivoting motion of the impeller (8) with respect to the drive wheel (2), whereas when the pressure is not applied to one of the pressure spaces (16, 17) the impeller (8) and the drive wheel (2) are mechanically coupled together. The mechanical coupling between the impeller (8) and the drive wheel (2) of the device (1) is accomplished by at least one axially moving vane (12) of the impeller (8) which is designed both as a vane pivoting element and as a locking element.

10 Claims, 3 Drawing Sheets

LOCKING UNIT FOR A DEVICE FOR MODIFYING THE TIMING OF CHARGE CHANGE VALVES IN INTERNAL COMBUSTION ENGINES

BACKGROUND OF THE INVENTION

The invention pertains to a locking mechanism for a device to modify the control timing of cylinder valves of an internal combustion engine, and especially to a vane-cell positioning device, including a drive wheel designed as an external rotor driven by a crankshaft of the internal combustion engine through a traction means, said drive wheel having a cavity formed by a perimeter wall and two side walls. The locking mechanism also includes an impeller that is placed in this cavity and designed as an internal rotor, permanently connected to a camshaft of the internal combustion engine. This impeller has at least one vane on the perimeter of its hub located in an axial notch and extending radially out from the hub. In the cavity of the drive wheel, at least one working chamber is formed by intermediate walls starting at the inside of the perimeter wall of the drive wheel and extending toward the longitudinal centerline of the device. Each of these working chambers is itself divided into two hydraulic pressure spaces by a vane of the impeller that extends into each working chamber. These hydraulic pressure spaces effect a pivoting motion and/or a fixing of the impeller with respect to the drive wheel by selectively, simultaneously, or with a time delay applying pressure from a hydraulic pressure medium. When the pressure is not applied in either of the pressure spaces, the impeller and the drive wheel can be coupled with one another mechanically in at least one preferred position with respect to one another.

A device of this type has already been categorized by patent U.S. Pat. No. 48,58,572. In a preferred embodiment of this device, six equally sized working chambers are formed between six intermediate walls located in the cavity of the drive wheel opposite one another in a circular direction. These working chambers themselves are each divided into a first and a second pressure space, which are liquid-tight with respect to one another, by means of six vanes fastened rigidly to the hub of an impeller connected to the camshaft. The mechanical coupling between the impeller and the drive wheel of the device is accomplished through either one of two spring-loaded locking pins located in a radial hole in an intermediate wall of the drive wheel engaging into a radial receiving hole located between two vanes of the hub in alternating fashion. This occurs when the vanes of the impeller are at one of their two end positions at the intermediate walls of the drive wheel and if the applied pressure from the hydraulic pressure medium is turned off at the first or second pressure space of the device. If, then, the pressure is reapplied to the respective pressure space and a specific value of the pressure of the pressure medium is exceeded, the respective locked locking pin is pushed completely into the radial hole in the intermediate wall and out of the receiving hole in the hub so that the mechanical coupling between the impeller and the drive wheel is again disengaged.

Another possibility of mechanical coupling between the impeller and the drive 20 wheel is suggested by the solution published in patent DE-OS 196 23 818. This solution is specifically intended for a pivoting-vane positioning device, which is comparable with respect to its basic design to a vane-cell positioning device, but with more massive vanes at the impeller and differing from it at most by only one to four working chamber(s). In this solution, an axial locking pin is located within one of the radial vanes of the impeller. This locking pin can be shifted parallel to the longitudinal centerline of the device and when the pressure of the hydraulic pressure medium decreases it is pushed by the force of a spring into an axial engagement opening in a front plate that is connected to the drive wheel. The engagement opening is hydraulically connected to one of the pressure spaces inside the device so that the pressure medium can also act on the front surface of the locked locking pin located in the engagement opening. When a certain value of pressure of the pressure medium is exceeded, the pressure medium pushes this pin again into its unlocked position within the vane.

However, these mechanical couplings between the impeller and the drive wheel of a vane-cell or pivoting-vane positioning device, in one case designed as a radial locking pin and in the other case designed as an axial locking pin, have the disadvantage in that they are constructed from a number of additional individual parts. Due to the necessary increase in expense to manufacture and install these parts, this raises the manufacturing costs of a vane-cell or pivoting-vane positioning device designed in this manner. Moreover, the danger exists in the design of the locking pin as simple pressure pins in both variations in that they deform when large stresses are absorbed from either rotating direction of the impeller, such that re-locking the device correctly can no longer always be guaranteed in every case. Also, the front surface of these types of locking pins, designed as pressure pins, is designed to be relatively small as a pressure application surface used for unlocking so that the pressure of the pressure medium sufficient to unlock only builds relatively late in the process, thus delaying the unlocking time of the device, which is detrimental.

SUMMARY OF THE INVENTION

The object of the invention is to produce a locking mechanism for a device to modify the control timing of cylinder valves of an internal combustion engine, in particular for a vane-cell positioning device. This locking mechanism distinguishes itself by having as small a number of individual parts as possible, thus lowering the manufacturing and installation costs, as well as by having as large a pressure application surface as possible for the hydraulic unlocking of the device for guaranteeing continued correct locking of the device, even after absorbing large stresses in both rotating directions of the impeller.

This object is met by means of the invention with a device according to the preamble of claim 1 in that the mechanical coupling between the impeller and the drive wheel of the device can be produced by at least one vane of the impeller being designed as an impeller pivoting element as well as at the same time being designed as a locking element. When the pressure of the hydraulic pressure medium necessary to pivot the impeller is not met, the vane can be fixed into a locked position relative to the drive wheel using an auxiliary energy source, and when a certain pressure of the hydraulic pressure medium is exceeded, it can be fixed by the pressure of the pressure medium into an unlocked or pivoting position within the working chamber associated with it.

An effective further development of the invention in this regard is that each vane of the impeller that is designed as a locking element is located within its axial notch in the hub of the impeller and is free to move axially, and one of its radial surfaces that seals against the side walls of the drive wheel is locked within an associated radial alignment notch on the inside of one of the side walls of the drive wheel in one or more locked positions of the device. In this regard, it is preferred that all vanes of the impeller, regardless of whether they are designed as locking elements at the same time or not, are also spring-mounted radially, preferably lying against a leaf or helical spring located inside their axial notch in the hub. In this way, a constant contact pressure is produced against the inside of the perimeter wall of the drive wheel, thus improving the pressure medium seal between the respective bordering pressure spaces at the free end of each vane opposite the spring.

It has proven to be cost effective to design only one vane of the impeller as a locking element of the device, independent of the number of vanes. This locking element, is fixed to the drive wheel in only one of its end positions, corresponding to mounting the device at an inlet or exhaust camshaft. The required radial alignment notch of this vane is preferred to be incorporated into the sidewall of the drive wheel that is furthest from the camshaft in the immediate vicinity of one of the intermediate walls of the drive wheel that border its working chamber or pressure spaces and that runs parallel to their stopping surfaces. However, it is also possible to locate the radial alignment notch in the same fashion in the sidewall of the drive wheel nearest the camshaft. Likewise, those solutions should be included under the scope of protection of the invention that have two or more vanes designed as locking elements that can all be locked in one of their end positions or, by arranging another radial alignment notch in the sidewall of the drive wheel furthest from or nearest to the camshaft inside each working chamber, in either of their end positions. It is also possible to design one or more vanes of the impeller so that it can be fixed in the first end position and to design one or more vanes to be fixed in the other end position of the vane and/or, by arranging other radial alignment notches in the working chambers, to also fix the impeller in one or more position(s) between the end positions if certain operating conditions of the internal combustion engine require it.

In refining the locking mechanism according to the invention, it is suggested moreover that the radial alignment notch in the inside of the sidewall of the drive wheel that is furthest from the camshaft have a length similar to the height of the lockable vane and to have a recess on a part of its length resulting from another pressure medium guide notch. The non-recessed parts of the notch base of the radial alignment notch are provided as axial stopping surfaces for the lockable vane. Moreover, the width of the radial alignment notch, which approximates the thickness of the lockable vane, is dimensioned such that the vane can be easily slid into the alignment notch while preventing chattering of the vane in its fixed position. Also, the side surfaces of the alignment notch act as stopping surfaces for the lockable vane in both rotating directions of the impeller. To make sliding the vane into the radial alignment notch more easily, it is also advantageous to chamfer or round off the longitudinal edges of the sealing surface of the vane that works together with the alignment notch, or as an equivalent measure to design the alignment notch to be slightly conical or to round off its edges.

Another feature of the locking mechanism according to the invention is that the pressure medium guide notch inside the radial alignment notch is connected to the pressure medium feed line feeding the pressure space of the device containing the radial alignment notch at its end nearest to the longitudinal centerline of the device. This connection is made using a pressure medium fill chute leading from the inside of the sidewall of the drive wheel that is furthest from the camshaft to the base of the pressure medium guide notch. By means of this pressure medium fill chute, the hydraulic pressure medium finds its way, starting from a pressure medium feed line that leads from the hub of the impeller to the pressure space of the device containing the radial alignment notch, into the pressure medium feed notch inside the radial guide notch. In this way, the pressure of the hydraulic pressure medium acting on the part of the radial sealing surface of the vane that does not lie against the stopping surfaces of the alignment notch in the locked position of the vane, which makes it a surface where pressure can be applied, causes the vane to shift axially into its unlocked position when a certain pressure value is exceeded. Alternatively, the locked vane can be hydraulically unlocked in the same way if instead of the pressure medium guide notch being contained within the radial alignment notch, a pressure application notch is incorporated into the sealing surface of the vane that works together with the alignment notch, preferably parallel to the longitudinal edges of this sealing surface. The pressure medium fill chute has the same arrangement and design as in the previously mentioned design of the alignment notch with the recessed pressure medium guide notch. It has proven to be advantageous in this regard if the intermediate walls in the cavity of the drive wheel each have pressure medium pockets, designed as cutouts in a known fashion, at their stopping surfaces that define the locking position of the impeller. These pressure medium pockets accelerate the filling of the pressure spaces, which are at minimum volume when the device is in its locked position, when pressure is applied to them. Thus, the pressure medium feed line to the pressure space containing the radial alignment notch and which is at minimum volume in the locked position of the device first flows into the pressure medium pocket of the adjoining intermediate wall. The pressure medium then flows into the pressure medium fill chute of the pressure medium guide notch inside the axial alignment notch. In this way, when pressure is applied to the pressure spaces that are at minimum volume, it is possible to transfer the pressure from the pressure medium nearly unhindered to the part of the radial sealing surface of the locked vane, which is designed as a pressure application surface, and a rapid and safe axial shift of the vane into its unlocked position is guaranteed.

With respect to manufacturing, it has been shown to be especially advantageous to sinter the alignment notch, the pressure medium guide notch and the pressure medium fill chute into the sidewall of the drive wheel that is furthest from the camshaft. This non-cutting manufacturing process prevents, at the outset, the functioning of the device from being affected by any milling residue later on. It is also possible, however, to incorporate the alignment notch, the pressure medium guide notch and the pressure medium fill chute into the sidewall of the drive wheel by cutting manufacturing processes such as by milling or similar processes. However, careful cleaning work of the work space is essential.

Furthermore, an advantageous refinement of the invention is suggested in that the necessary auxiliary energy to fix the vane into its locked position is produced using at least one pre-tensioned spring means acting in the locking direction. To this end, for example, two helical compression springs or conical springs have proven to be especially advantageous, each located inside an axial base hole in the radial sealing surface of the lockable vane nearest the camshaft. The number of these springs and their tension can be varied as desired depending on the space requirements or can be adjusted according to the conditions. In order to prevent relative motion between the spring means arranged in this way and the sidewall of the drive wheel nearest the camshaft, as well as to guide the spring means, which can easily buckle in these types of applications, each spring means is designed to fit over an axial guide pin inside its base hole in the lockable vane, to further solidify the locking mechanism according to the invention. This guide pin has a cross sectional enlargement at its end nearest the camshaft that can be countersunk into the base hole in the unlocked position of the vane. In this way, the spring media are supported on one hand at the back of the base hole and on the other hand at the annular cross sectional transition surface of their guide pins, whereas the end surface of each guide pin nearest the camshaft permanently sits against the sidewall of the drive wheel nearest the camshaft. Therefore, to reduce the friction between the guide pins and the sidewall of the drive wheel nearest the camshaft during the positioning operation of the device, the end surface of each spring media guide pin nearest the camshaft is preferably designed as convex, which is another feature of the invention, so that it slides against the inside of the sidewall of the drive wheel nearest the camshaft only at points. To further improve the wear resistance of the guide pins, it is advantageous moreover to design them to be case-hardened or, instead of the convex design of the end of the guide pin nearest the camshaft, to provide this end with a plastic layer to reduce the friction. Also, the guide pins can be designed completely as injection molded plastic parts or as cast parts made of zinc or brass.

Finally, it is suggested as another feature of the locking mechanism according to the invention that the outside surface of each guide pin as well as the outside surface if its cross sectional enlargement in the longitudinal direction of the base hole be designed conically and that each guide pin have a pressure equalization line for the hydraulic pressure medium, designed as a penetration hole along its longitudinal centerline. By designing the conical guide pins to be narrower in the direction away from the camshaft, sliding them into their base holes when the vane is unlocked is made easier. This can also be accomplished by designing the base holes in the lockable vanes and their countersinking for the cross sectional enlargement of the guide pins to be conical instead of the outer surfaces of the guide pins. The pressure equalization line in the guide pins designed as a penetration hole facilitates the displacement of hydraulic pressure medium located in the base holes when the vane is unlocked. This can also be done through other suitable means such as, for example a flattening on one side of the outer surfaces of the guide pins or by means of a threaded drainage notch in the outer surface of each guide pin.

The locking mechanism according to the invention for a device to modify the control timing of cylinder valves of an internal combustion engine of the vane-cell positioning type thus has, in contrast to the locking mechanisms known from the state of the art, the advantage that only a minimum of additional individual parts or work steps are necessary to accomplish a locking together of the impeller with the drive wheel in one or more positions. This is because of the simultaneous use of a vane of the impeller as a pivot- and a locking element. In this way, the locking mechanism according to the invention differentiates itself from the known locks advantageously by an enormously favorable cost for material and manufacturing, such that the manufacturing costs for a vane-cell positioning device having this type of lock increases only slightly compared to vane-cell positioning devices without locks. Moreover, the locking mechanism according to the invention is differentiated through a high functional safety with respect to the absorption of large stresses in both rotating directions of the impeller since the entire radial length of the vane which functions as a locking element is fixed in an alignment notch incorporated into a sidewall of the drive wheel with the same length. Thus, the vanes force absorption capability is sufficient for sustained, correct locking. Likewise, the radial sealing surface of the vane used to unlock the vane is larger than the end surface of known locking pins so that the pressure of the pressure medium necessary to unlock the vane is reduced, as is the time to unlock the vane.

A characteristic feature of the locking mechanism according to the invention is, moreover, that in the locked position of the lockable vane, a hydraulic short-circuit between the pressure spaces bordering the vane occurs since by axially shifting it between the sealing surface of the vane closest to the camshaft and the inside of the sidewall of the drive wheel closest to the camshaft, a gap arises having approximately the same depth as the radial alignment notch. What results is that when pressure is applied to the minimum-volume pressure spaces in the locked position, both pressure spaces bordering the locked vane are filled with the pressure medium at the same time first before the vane is unlocked. This effect, which in and of itself is undesirable, nonetheless has the advantage, in particular with regard to the locking of the vane in an intermediate position lying between its end positions, in that the impeller is already being hydraulically held in its position relative to the drive wheel—directly after being unlocked—by at least one pair of pressure spaces of the device, and that this pair of pressure spaces is completely vented due to the bypassing of the hydraulic pressure medium.

To prevent the hydraulic short-circuiting between the pressure spaces bordering the lockable vane and the effects resulting therefrom, it is only necessary to leave out the pressure medium pocket at the stopping surface of the intermediate wall in the cavity of the drive wheel that the lockable vane lies against in the locked position. This allows the hydraulic pressure medium to first only flow into the other pressure spaces, which as before are designed with pressure medium pockets, when pressure is applied accordingly, whereas the pressure medium feed line to the minimum-volume pressure space bordering the lockable vane is blocked by means of the respective intermediate wall of the drive wheel. However, since in this case the pressure medium feed line is, as before, connected to the pressure medium fill chute, thus making it possible to have a pressure medium flow into the radial alignment notch of the locked vane, this at least will be unlocked by the application of pressure. Filling the minimum-volume pressure space at the bordering lockable vane is then possible subsequent to the unlocking of the vane when the impeller rotates relative to the drive wheel as a result of filling the other minimum-volume pressure spaces, thus automatically disengaging the block of the pressure medium feed line due to the intermediate wall of the drive wheel.

BRIEF DESCRIPTION OF THE DRAWINGS

The invention is described in more detail below on the basis of a preferred embodiment. In the drawings, the following is shown.

DETAILED DESCRIPTION OF THE PREFERRED EMBODIMENT

Figure 1:
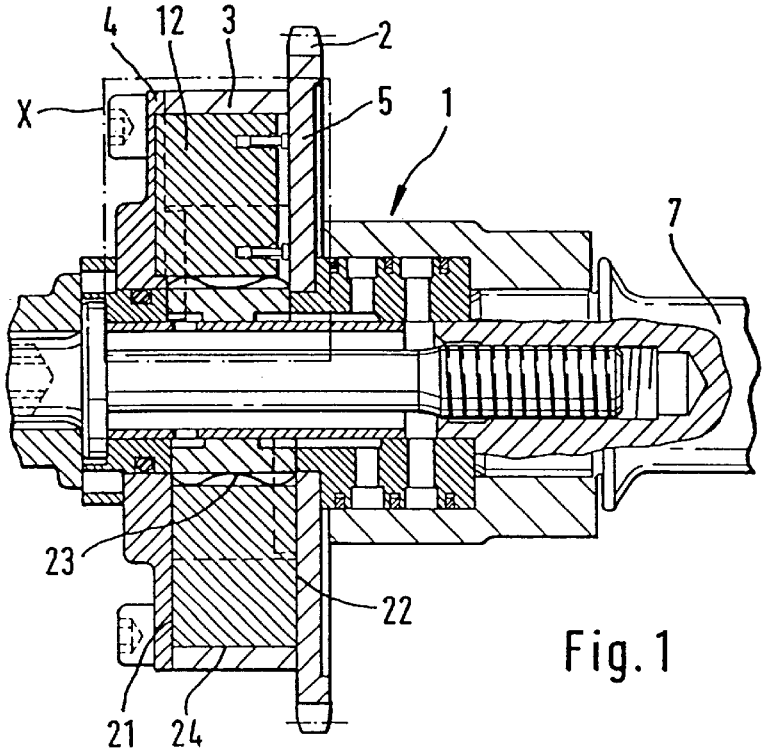
FIG. 1 is a longitudinal section through a vane-cell positioning device with a locking mechanism according to the invention.
Figure 2:
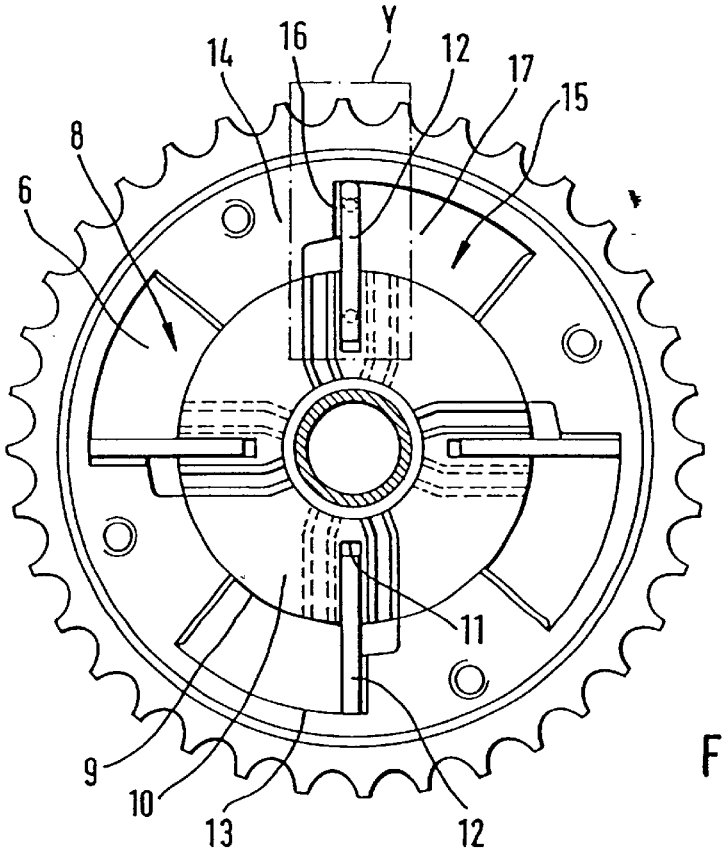
FIG. 2 is a top view of the vane-cell positioning device with a locking mechanism according to the invention with the sidewall of the drive wheel that is furthest from the camshaft removed.

FIGS. 1 and 2 clearly depict a device 1 designed as a vane-cell positioning device to modify the control timing of cylinder valves of an internal combustion engine. This device includes a drive wheel 2 designed as an external rotor which is driven through connection with a crankshaft, not shown, of the internal combustion engine by means of a traction means, as well as an impeller 8 designed as an internal rotor which is permanently connected to a camshaft 7 of the internal combustion engine. FIGS. 1 and 2 also show that the drive wheel 2 has a cavity 6 formed by a perimeter wall 3 and two sidewalls 4, 5, in which four working chambers 15 are formed by four intermediate walls 14 extending from the inside 13 of the perimeter wall 3 toward the longitudinal centerline of the device 1. The impeller 8, having four vanes 12 at the perimeter 9 of its hub 10, each of which is located in an axial notch 11 and extends out away from the hub 10 radially, is placed in this cavity 6. These vanes 12 each extend into a working chamber 15 in the drive wheel 2 and divide it into two hydraulic pressure spaces 16, 17. By selectively, simultaneously, or with a time delay applying pressure to these pressure spaces 16, 17 using a hydraulic pressure medium, the impeller 8 can be pivoted and/or fixed with respect to the drive wheel 2. This rotates the camshaft 7 relative to the crankshaft of the internal combustion engine in a known fashion and/or is hydraulically held.

In order to prevent undesired noise, due to the alternating moments of the camshaft 7, which occurs when the vane 12 of the impeller 8 hits the intermediate walls 14 of the drive wheel 2 at a high frequency when the internal combustion engine is started (at which point the device 1 is located in its most pressure-less state), at least one vane 12 of the impeller 8 of the device 1 is designed both as an impeller pivoting element and at the same time as a locking element. This is for the purposes of creating a mechanical coupling between the impeller 8 and the drive wheel 2. This vane can be fixed in a locked position at the drive wheel 2 using an auxiliary energy means when the pressure of the hydraulic pressure medium needed to pivot the impeller 8 is not met. It can also be fixed in an unlocked or pivoting position inside the working chamber 15 associated with it when the pressure of the pressure medium exceeds a certain hydraulic pressure.

Figure 5:
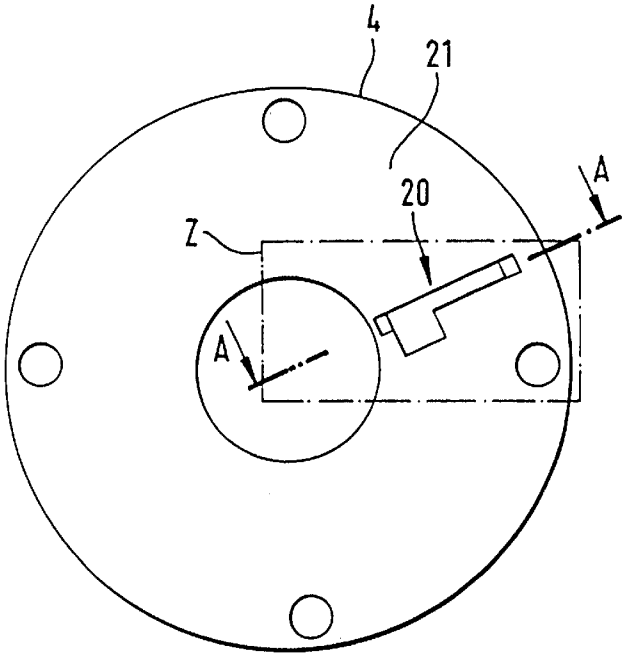
FIG. 5 is a top view of the inside of the sidewall of the drive wheel that is furthest from the camshaft with a radial alignment notch according to the invention.
Figure 3:
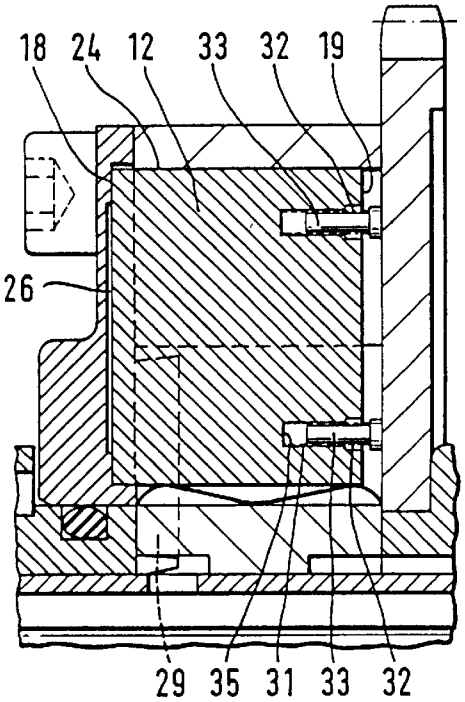
FIG. 3 is an enlarged view of the area indicated by an X in FIG. 1 of a vane of the impeller designed as a locking element according to the invention.
Figure 6:
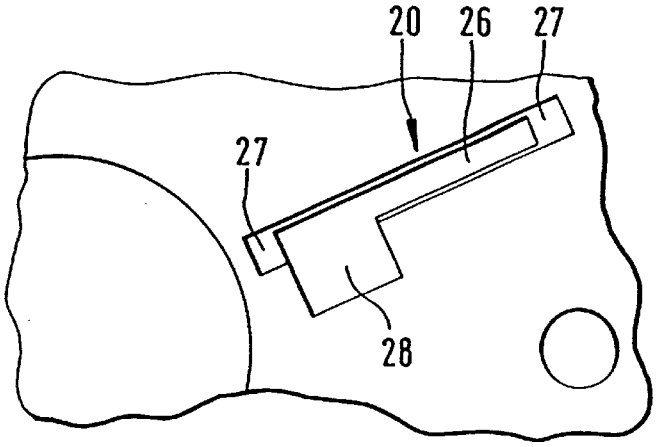
FIG. 6 is an enlarged view of the area indicated by a Z in FIG. 5 of the radial alignment notch in the sidewall of the drive wheel that is furthest from the camshaft.
Figure 7:
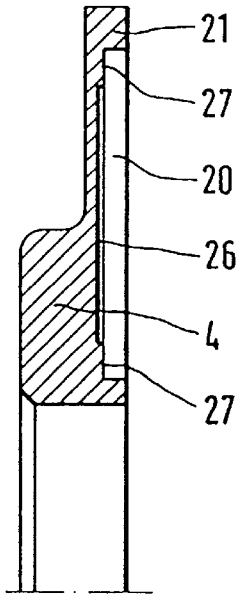
FIG. 7 is an enlarged view of section A—A according to FIG. 5 along the longitudinal centerline of the radial alignment notch in the sidewall of the drive wheel that is furthest from the camshaft.

In FIGS. 2 and 3, it is seen that of the four vanes 12 of the impeller 8, which are all spring-mounted radially inside their axial notch 11 in the hub 10, lying on leaf springs 23 to produce a continuous contact pressure of their free ends 24 against the inside 13 of the perimeter wall 3, only one vane 12 is designed as a locking element. It shifts axially inside of its axial notch 11 in the hub 10 of the impeller 8, and its radial surface 18 which seals against the sidewall 4 of the drive wheel 2 locks together with a radial alignment notch 20 on the inside 21 of the sidewall 4, as shown in FIGS. 5 through 7. In the embodiment shown, this axial alignment notch 20 is in the direct vicinity of the intermediate wall 14 of the drive wheel 2, which borders the working chamber 15 of the lockable vane 12 and its pressure space 16. It is also sintered into the sidewall 4 of the drive wheel 2 that is furthest from the camshaft, running parallel to its stopping surface 25, which is described in more detail in FIG. 4. This enables the vane 12 to be fixed only at one of its end positions, or in concrete terms at the start position of the camshaft 7 in relation to the drive wheel 2 that is best for the starting of the internal combustion engine.

Figure 4:
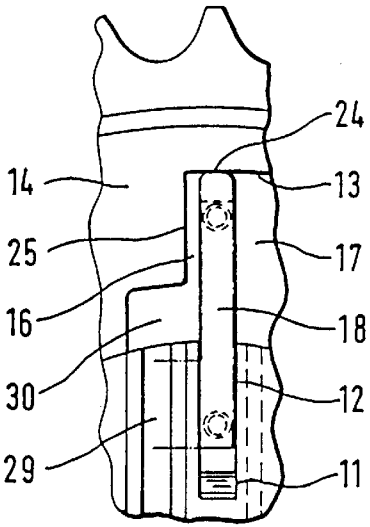
FIG. 4 is an enlarged view of the area indicated by a Y in FIG. 2 of a vane of the impeller designed as a locking element according to the invention.

Moreover, FIG. 3 shows that the radial alignment notch 20 on the inside 21 of the sidewall 4 of the drive wheel 2 that is furthest from the camshaft has a length that is very close to the height of the lockable vane 12 and part of its length is slight recessed by means of another likewise sintered pressure medium guide notch 26. As shown in FIGS. 6 and 7, the parts of the notch base of the radial alignment notch 20 that are not recessed are provided as axial stopping surfaces 27 for the lockable vane 12 in its fixed position. They also show that the pressure medium guide notch 26 within the radial alignment notch 20 has a pressure medium fill chute 28 at its end closest to the longitudinal centerline of the device 1 which leads from the inside 21 of the sidewall 4 of the drive wheel that is furthest from the camshaft to the base of the pressure medium guide notch 26. This fill chute also is incorporated by sintering. Thus, as shown in FIG. 4, this pressure medium fill chute 28 connects the pressure medium guide notch 26 to the pressure medium feed line 29 that feeds the pressure space 16 of the device 1 containing the radial alignment notch 20. A pressure medium pocket 30 incorporated into the stopping surface 25 of the intermediate wall 14 of the drive wheel 2 also accomplishes this. The result is that the locked position of the device 1 is disengaged and the lockable vane 12 is returned to its moving, unlocked position as the pressure space 16 is subjected to pressure.

Furthermore, FIG. 3 shows that the necessary auxiliary energy to fix the vane 12 in its locked position can be produced using two spring means 31 that are each located inside an axial base hole 32 in the sealing surface 19 of the lockable vane 12 closest to the camshaft and that are designed as conical springs. These spring means act in the locking direction with a certain pre-loaded tension. Each of these spring means 31 fit over an axial guide pin 33, enlarged in FIG. 8, inside their base holes 32 in the lockable vane 12. This guide pin has an enlargement in cross section 34 at its end closest to the camshaft that can be countersunk into the base hole 32. In this way, the spring means 31 are support on one hand at the back 35 of the base hole 32 and on the other hand at the annular surface 36 at the transition of cross section of the guide pin 33 and are secured against buckling during the relative motion between the drive wheel 2 and the impeller 8.

Figure 8:
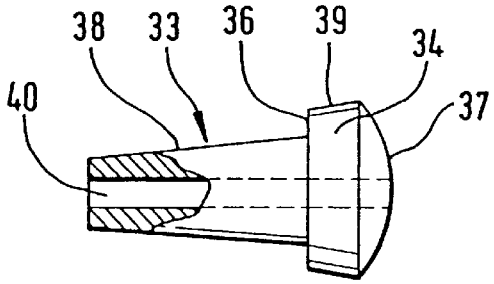
FIG. 8 is an enlarged side view of a guide pin for the spring media to produce the auxiliary energy for the lockable vane of the impeller according to the invention.

Finally, it can also be seen in FIG. 8 that the end surface 37 of each guide pin 34 closest to the camshaft is designed as convex to reduce the friction between the guide pins 33 and the sidewall 5 of the drive wheel closest to the camshaft, thus gliding against the inside 22 of the sidewall 5 only at points. Moreover, the outer surface 38 of each guide pin 33 as well as the outer surface 39 of its enlarged cross section 34 is designed as conical, as shown in the same illustration, in order to make the sliding of the guide pins 33 into their base holes 32 easier when the vane 12 is unlocked. A pressure equalization line 40, designed as a passage along the longitudinal centerline of the guide pins 33, serves to facilitate the displacement of the hydraulic pressure medium located in the base holes 32.

ELEMENT LIST

1 Device
3 Perimeter Wall
2 Drive wheel
4 Sidewall furthest from the camshaft
5 Sidewall nearest to the camshaft
6 Cavity
7 Camshaft
8 Impeller
9 Perimeter of the impeller
10 Hub
11 Axial notch
12 Vane
13 Inside of the perimeter wall
14 Intermediate walls
15 Working chamber
16 Pressure space
17 Pressure space
18 Sealing surface furthest from the camshaft
19 Sealing surface nearest to the camshaft
20 Alignment notch
21 Inside
22 Inside
23 Leaf spring
24 Free end
25 stopping surfaces
26 Pressure medium guide notch
27 Stopping surfaces
28 Pressure medium fill chute
29 Pressure medium feed line
30 Pressure medium pockets
31 Spring media
32 Base hole
33 Guide pin
34 Cross section enlargement
35 Back
36 Cross sectional transition surface
37 End surface
38 Outside surface
39 Outside surface
40 Pressure equalization line

What is claimed is:

1. A device to modify the control timing of cylinder valves of an internal combustion engine, comprising a drive wheel (2) designed as an external rotor driven by a crankshaft of the internal combustion engine through a traction means, said drive wheel having a cavity (6) formed by a perimeter wall (3) and two side walls (4, 5), said device also including an impeller (8) that is located in the cavity (6) and designed as an internal rotor, connected to a camshaft (7) of the internal combustion engine, said impeller having at least one vane (12) on a perimeter (9) of a hub (10) located in an axial notch (11) and extending radially out from the hub (10), wherein at least one working chamber (15) is formed in the cavity (6) of the drive wheel (2) by means of intermediate walls (14) starting at an inside (13) of the perimeter wall (3) of the drive wheel (2) and directed toward a longitudinal centerline of the device (1), each of said working chambers being divided into two hydraulic pressure spaces (16, 17) by the associated vane (12) of the impeller (8) that extends into the working chamber (15), said hydraulic pressure spaces effecting a relative rotation or a hydraulic clamping of the impeller (8) with respect to the drive wheel (2) by selectively, simultaneously, or with a time delay applying pressure from a hydraulic pressure medium, whereas when the pressure of the pressure medium in the pressure spaces (16, 17) is less than needed to pivot or hold the impeller, the impeller (8) and the drive wheel (2) are coupled with one another mechanically in at least one preferred position with respect to one another, characterized in that the coupling between the impeller (8) and the drive wheel (2) of the device (1) is produced by at least one vane (12) of the impeller (8) designed as a locking element and being movable axially in the associated axial notch (11) on the hub (10), one of the radial sealing surfaces (18, 19) of said vane sealing against the sidewalls (4, 5) of the drive wheel (2) capable of being fixed by means of an auxiliary energy source into a locked position within a radial alignment notch (20) on the inside (21 or 22) of one of the side walls (4 or 5) of the drive wheel (2), and said vane being movable into an unlocked or pivoting position inside its associated working chamber (15) when a specific pressure of the hydraulic pressure medium is exceeded.

2. A device according to claim 1, characterized in that only one vane (12) of the impeller (8) is provided at one time as a locking element of the device (1), and is fixed to the drive wheel (2) in only one of the end positions with the radial alignment notch (20) being incorporated into the side wall (4) of the drive wheel (2) furthest from the camshaft in the vicinity of one of the intermediate walls (14) of the drive wheel (2) bordering the working chamber (15) and the pressure spaces (16, 17) and extend parallel to stopping surfaces (25).

3. A device according to claim 1, characterized in that the radial alignment notch (20) in the inside (21) of the side wall (4) of the drive wheel (2) furthest from the camshaft has a length that is nearly equal to the height of the lockable vane (12) and has a slight recess on a part of its length due to another pressure medium guide notch (26), wherein the parts of the notch base of the radial alignment notch (20) that are not recessed are provided as axial stopping surfaces (27) of the lockable vane (12) in its fixed position.

4. A device according to claim 3, characterized in that the pressure medium guide notch (26) inside the radial alignment notch (20) is connected by a pressure medium feed line (29) to the pressure space (16) of the device (1) containing the radial alignment notch (20), said connection being at the end of the alignment notch that is closest to the longitudinal axis of the device (1) and formed by a pressure medium fill chute (28) that leads from the inside (21) of the side wall (4) of the drive wheel (2) furthest from the camshaft to a base of the pressure medium guide notch (26).

5. A device according to claim 3, characterized in that the alignment notch (20), the pressure medium guide notch (26) and the pressure medium fill chute (28) are sintered into the side wall (4) of the drive wheel (2) furthest from the camshaft or into the side wall (5) nearest to the camshaft.

6. A device according to claim 1, characterized in that the auxiliary energy needed to fix the vane (12) in its locked position is produced by two helical compression or conical pre-tensioned spring means (31) acting in the direction of locking, each located inside an axial base hole (32) in the sealing surface (19) of the lockable vane (12) closest to the camshaft.

7. A device according to claim 6, characterized in that each spring means (31) is designed to fit over an axial guide pin (33) inside the base hole (32) in the lockable vane (12), said guide pin having an enlarged cross section (34) at an end closest to the camshaft that is countersunk into the base hole (32), wherein each of the spring means (31) is supported on one end at the back (35) of the base hole (32) and on the other end at an annular cross sectional transition surface (36) of the guide pin (33).

8. A device according to claim 7, characterized in that the end surface (37) of each of the guide pins (33) for the spring means (31) closest to the camshaft is convex and slides on the inside (22) of the side wall (5) of the drive wheel (2) closest to the camshaft at contact points.

9. A device according to claim 7, characterized in that the outer surface (38) of each of the guide pins (33) as well as the outer surface (39) of the enlarged cross section (34) are conically shaped in a longitudinal direction of the base hole (32) and each guide pin (33) has a pressure equalization line (40) for the hydraulic pressure medium designed as a penetration along its longitudinal centerline.

10. A device according to claim 4, characterized in that the alignment notch (20), the pressure medium guide notch (26) and the pressure medium fill chute (28) are sintered into the side wall (4) of the drive wheel (2) furthest from the camshaft or into the side wall (5) nearest to the camshaft.

* * * * *